United States Patent [19]

Kifferstein

[11] 4,366,956

[45] Jan. 4, 1983

[54] RHYTHM INDICATING EXERCISERS

[76] Inventor: Harry P. Kifferstein, 27250 Harvard Rd., Southfield, Mich. 48076

[21] Appl. No.: 180,840

[22] Filed: Aug. 25, 1980

Related U.S. Application Data

[63] Continuation-in-part of Ser. No. 51,113, Jun. 22, 1979, Pat. No. 4,278,248.

[51] Int. Cl.[3] ..... A63B 21/00

[52] U.S. Cl. ..... 272/70; 46/193

[58] Field of Search ..... 272/67, 68, 70, 117, 272/122, 123, 124, 128; 46/193, 191

[56] References Cited

U.S. PATENT DOCUMENTS

| | | | |
|---|---|---|---|
| 466,276 | 12/1891 | Le Garde | 272/122 |
| 2,268,684 | 1/1942 | Zadek | 46/193 |
| 2,509,810 | 5/1950 | Core | 272/122 |
| 3,006,646 | 10/1961 | Nanni | 272/67 |
| 3,514,898 | 6/1970 | Price | 46/191 X |
| 4,218,057 | 8/1980 | Wilson | 272/117 |
| 4,278,248 | 7/1981 | Kifferstein | 46/193 |

*Primary Examiner*—Richard J. Johnson
*Attorney, Agent, or Firm*—Hauke and Patalidis

[57] ABSTRACT

A rhythm indicating exercising device in the form of a generally tubular member having a preferably metallic mass or slug disposed freely slidable in the interior of the tubular member, each end of the tubular member being provided with an end closure preventing the mass or slug from escaping from the tubular member. In use, one tubular member is grasped in one hand or, preferably, a pair of tubular members are held one in each hand of a person while walking and more particularly while engaged in aggressive exercise walking, that is while walking at a fast pace with extensive swinging of the arms back and forth. At the end of each forward and backward stroke of the arm, the mass or slug is forcibly propelled by inertia within the tubular member and caused to strike the corresponding end closure, thus producing an impact knocking sound helping the walker to maintain an effective rhythm and providing beneficial advantages in indicating proper exercising of the arms in addition to the legs.

19 Claims, 11 Drawing Figures

RHYTHM INDICATING EXERCISERS

CROSS-REFERENCE TO RELATED APPLICATION

The present application is a continuation-in-part of application Ser. No. 051,113, filed June 22, 1979 now U.S. Pat. No. 4,278,248.

BACKGROUND OF THE PRESENT INVENTION

Recent years have witnessed a remarkable growth in an occupation, aptly called "jogging", which is best enjoyed, or suffered, solitarily, although sometimes practiced in pairs or in groups. Some social observers have ponderously qualified jogging as a way of life, a philosophy, a mystique, a fad, a cult, or simply a form of snobbism, rather than a sport or a search for physical form, fitness and well-being. Joggers of all ages, sizes, cultural and ethnic backgrounds, colors and denominations, have invaded highways, country roads, streets, avenues, parks, parking lots, airport taxiways, and cemeteries. Even the fashion industry has been influenced by jogging.

As many rural and urban, but sedentary, observers have sarcastically remarked, jogging has opened new chapters on modern mankind's perpetual pursuit for happiness and physical fitness. The advantages and disadvantages of jogging have been perpetuated by the authors of many articles and books. One advantage is that jogging does not require any auxiliary equipment short of an appropriately fashionable garb, preferably of bright colors. Another advantage of jogging is that it appears, at least when indulged in within the physical limitations of the jogger, to be a healthfully beneficial endeavor and to provide a good muscular and cardiovascular exercise resulting in improved stamina, intensified perspiration and consequential loss of undesirable and undesired weight through active burning of body fat and elimination of tissue water. However, jogging has also many inconveniences, either momentary and reversible or permanent and irreversible, such as, for example, arrhythmia, tachycardia, ventricular fibrilation, hyperventilation, muscle cramps, endurance fatigue and stress, kidney and urinary disorders, stomach and intestinal problems, feet blistering, carbon monoxide inhalation, broken bones, worn-out joints, chronic joint and lung inflamation, ruptured ligaments and tendons, and dog bites.

An alternate to jogging is walking. Walking is a natural human action which, while still enjoyed by a few, has fallen into disrepute in view of the more conventional alternative provided by motorized means and private transportation. This disrepute has reached the point that walking, one of man's and woman's most natural functions, is often casually prescribed by physicians ironically for its therapeutic value. Walking, however, does not require any special equipment or field, court, rink, course or pool. Walking does not require any special clothing, garb, or uniform.

Long distance walking, or marathon walking, is a very popular competitive sport long practiced in many countries, recognized by sporting clubs and associations, and rewarded by national and international championships. Such competitive aggressive fast-paced walking takes place under strict rules, one of which requiring that each step be effected with the heel of the foot first contacting the ground. Competitive marathon walkers, or marchers, are, in the course of an officially sponsored contest, under constant observation and scrutiny by umpires and referees and immediately disqualified if violating any of the rules.

Competitive walkers, or marchers, walk at a rhythmic pace and fling their extended arms, using their shoulders as pivots, in synchronized timing with the walking legs, the right and left arms swinging rhythmically in opposite directions to the strides of respectively right and left legs. In other words, simultaneously with throwing his or her right leg forward, the competitive walker throws his or her right arm backward and his or her left arm forward, and vice versa. Competitive walkers are complete athletes, with fully developed muscles in the arms, neck, shoulders, upper and lower back, chest, belly as well as the legs.

Without engaging into such an aggressive competitive walking, any average person can achieve his or her sought-after physical fitness, and in addition benefits from greatly improved muscular functions, strengthened heart muscles, and increased cardiac output, pulmonary capacity and physical stamina and endurance, by exercising through aggressive walking without suffering the inconveniences, pains and side effects of jogging. Although walking, like bicycling, may be enjoyed at a leisurely pace, it must be practiced in a somewhat vigorous and aggressive manner, in the form of an exercise, in order to attain all of the expected physical and health advantages. It has been noted, however, that most "amateur" walkers tend to be originally lax in properly and vigorously swinging their arms in time with their leg strides or, if at first somewhat energetic in their arm action, they tend to become progressively lax after a short period of time.

There is therefore a need for an exercising device for aiding an aggressive walker to achieve proper motion-timing and, in addition, providing an indicator of adequate arm motions in synchronism with leg motions. The inventions disclosed in the aforesaid prior application and in the following description provide such a rhythm indicator, arm exerciser and detector of proper arm actions for a person engaged in practicing vigorous aggressive walking while, at the same time, providing him or her with a relatively light hand-supported load, which, if so desired, can be progressively increased as arm and shoulder muscles develop. It has experimentally been determined, through the use of tests such as commonly referred to as "stress tests" wherein a subject is caused to walk vigorously on a power-driven belt or "treadle", that oxygen lung intake is increased by approximately 20–25% through the proper use of the invention, as compared to running the same tests in the usual manner with the subject grasping the test device handle bar and keeping his or her arms motionless.

SUMMARY OF THE INVENTION

The principal object of the present invention is to provide a simple hand graspable unit which functions as a rhythm indicator and as a detector of proper swinging of the arms during vigorous aggressive walking, and which can be used as a training tool for the average person attempting to improve his or her physical well-being and aptitudes as well as for the athlete aiming at improved performance.

The diverse objects and advantages of the present invention will become apparent to those skilled in the art when the following description of examples of the best modes contemplated for practicing the invention is read in conjunction with the accompany drawing wherein like numerals refer to like or equivalent parts and in which:

BRIEF DESCRIPTION OF THE DRAWING

FIG. 2(*a*) is an end view thereof from line 2(*a*)—2(*a*) of FIG. 2;

FIG. 7(*a*) is an end view of the modification of FIG. 7 as seen from line 7(*a*)—(7*a*) of FIG. 7.

DETAILED DESCRIPTION OF THE PREFERRED EMBODIMENTS

Figure 1:
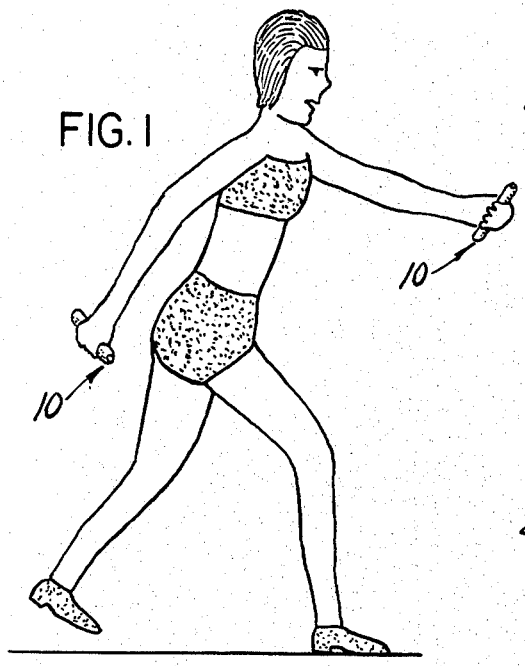
FIG. 1 is a schematic representation of a person engaging in vigorous, aggressive walking while using the invention.

Referring to FIG. 1, there is schematically illustrated a walker engaged in vigorous, aggressive walking, while holding in his or her hand a rhythm indicator and exercising device 10 according to the present invention. In order to properly exercise the upper torso and, more particularly, the back, the chest, the shoulder and the arm muscles, and in order to establish proper balance and natural stride while engaging in aggressive walking, when the right leg, for example, is propelled forwardly the right arm is swung vigorously backward, pivoting around the shoulder, and the end of the backward swing of the arm corresponds substantially in real time to the end of the forward stroke of the right leg, and vice versa. Each arm is therefore caused to be swung backward approximately to the limit permissible without undue strain and, subsequently and in synchronism with the motion of the legs, swung forward to at least a substantially horizontal position. By carrying a rhythm indicator and exercising device 10 according to any one of the structures disclosed in the aforesaid application and as illustrated at FIGS. 2–9 herein, an appropriate clicking or knocking sound is heard at the end of the back swing of each arm, and again is heard at the end of the forward swing of each arm. In this manner, at least two important results are achieved by the user of the invention. First, he or she is able to determine when sufficient swing of the arm has been achieved when an impact sound is emitted at each end of the arm swing and, secondly, by synchronizing the impact sound he or she is able to establish and maintain an appropriate rhythmic or cadence swinging of the arms coinciding appropriately with the cadence of the footsteps.

Figure 2:
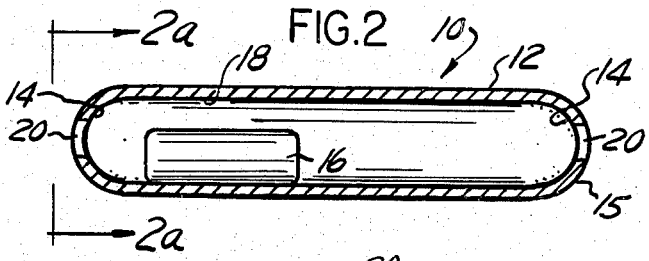
FIG. 2 is a longitudinal section through an example of structure for a rhythm indicating exerciser according to the present invention.
Figure 2A:
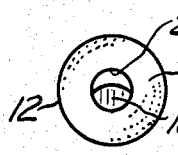
Figure 3:
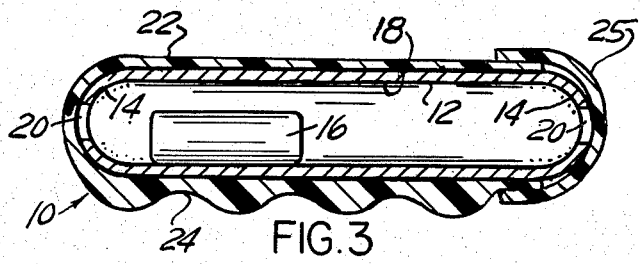
FIG. 3 is a view similar to FIG. 2 but showing a modification thereof.

As illustrated in detail at FIGS. 2–2(*a*), each rhythm indicator and exercising device 10, in its simplest form, comprises a tubular member 12 provided at each end with a stop member or closure wall 14. The stop closure walls 14 prevent a weighted mass or metallic slug 16, loosely disposed in the interior bore 18 of the tubular member 12 from being thrown out of the tubular member 12 either by inertia or by gravity in any position of the tubular member, as a result of an end of the weighted mass or slug 16 engaging an end wall 14. When the tubular member 12, held in the hand of a person, is propelled in a direction along an arc of a circle and suddenly stopped, the weighted mass or slug 16, by inertia, impacts against one of the end walls 14, and is caused to impact upon the other end wall 14 as a result of the arm being swung in an opposite direction and of the sudden stopping of the motion of the arm. Each time the weighted mass or slug 16 impacts upon an end wall 14, a clicking or knocking sound is emitted, which indicates to the user that an appropriate amount of energy has been used for swinging the arm and that the motion of the arm has been stopped at the intended upward end of the swing arc.

In the structure of FIGS. 2–2(*a*), the tubular member 12 is preferably metallic, although it may be made of a plastic material, and the end walls 14 are formed integrally by swaging the ends of the tubular member 12, as shown at 15, after cutting the tubular member to an appropriate length and after introducing the weighted mass or slug 16 within the bore 18 in the tubular member. The ends of the tubular member 12 are swaged only to the appropriate amount necessary for stopping the weighted mass or slug 16 such that the end walls 14 are provided with an aperture 20 having a diameter less than the overall diameter of the weighted mass or slug 16.

Preferably, the tubular member 12 has an outer diameter of about 25 mm to 50 mm, appropriate for enabling grasping the tubular member 12 in one hand, and has a length of, for example, 100 mm to 160 mm. Whether made of metal or plastic, the tubular member 12 may be used as such or, preferably, it is disposed in a sleeve 22, FIG. 3, made of rubber or other convenient material such as polypropylene and the like provided on one side with indentations, as shown at 24, to form a convenient, non-slipping hand grip. For the sake of convenience and for providing a good appearance a cap 25, made of the same material as the grip sleeve 22 is fastened on the other end of the tubular member 12.

Figure 4:
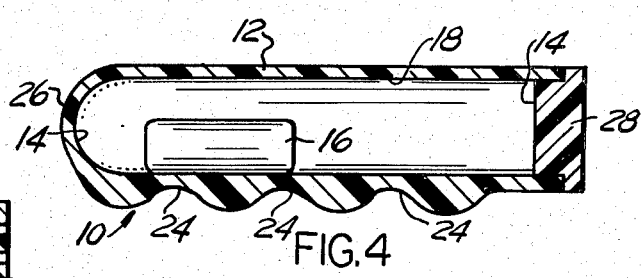
FIGS. 4–9 are views similar to FIG. 2 but showing further alternate modifications thereof.
Figure 7:
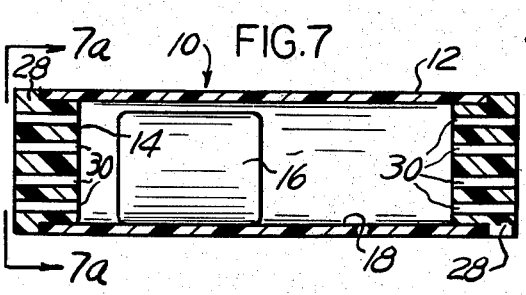

FIG. 4 represents another example of structure for a rhythm indicator and exercising device 10 according to the invention consisting of a molded plastic tubular member 12 provided peripherally on one side with grip indentations 24. The tubular member 12 is provided with an integrally molded closure wall 26 at one end and a closure cap or plug 28, also preferably made of plastic, cemented or otherwise fastened to the normally open other end of the tubular member 12, after the weighted mass or slug 16 has been loosely disposed within the internal bore 18 of the tubular member.

Figure 5:
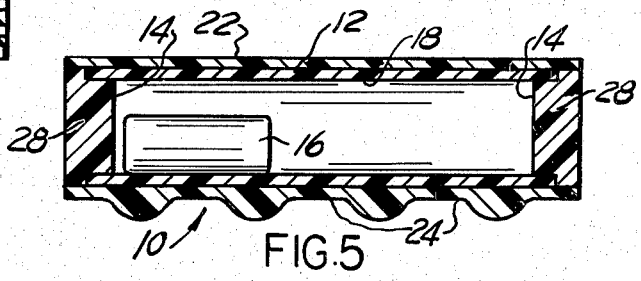
Figure 7A:
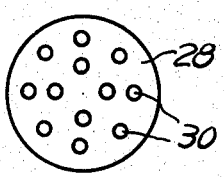
Figure 8:
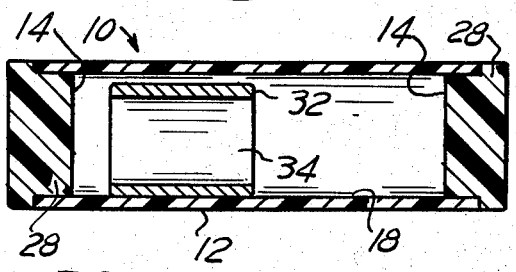

FIG. 5 illustrates a further example of structure comprising a straight tubular member 12, either metallic or made of metal, closed at each end by a closure cap or plug 28. The tubular member 12 is disposed within a grip sleeve 22, which is substantially tubular and cut long enough to cover the edge of the closure caps or plugs 28.

It will be appreciated that the weighted mass or slug 16 may have any appropriate length and diameter for loosely fitting within the bore 18 between the end walls 14 whether the end walls are formed integral or consist of closure caps or plugs. However, unless the tubular member 12 is provided with an aperture at each end through its closure wall 14 as, for example, shown at 20 at FIG. 2, the diameter of the weighted mass or slug 16 is preferably substantially less than the inner diameter of the tubular member 12 in the bore 18, such as to prevent the weighted mass or slug 16 from acting as a piston compressing air between its face and the surface of an end wall 14 while being displaced toward that end wall. Providing the weighted mass or slug 16 with a diameter substantially less than that of the internal bore 18 of the tubular member 12 permits considerable leakage of air from a side of the weighted mass or slug 16 to the other during displacement of the weighted mass or slug within the tubular member.

Figure 6:
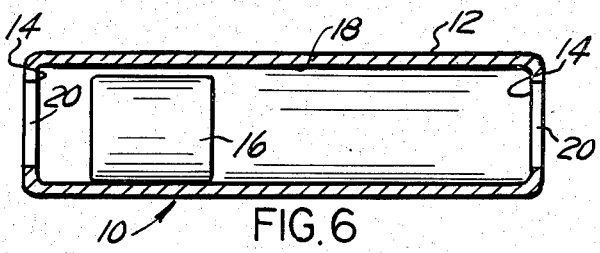

FIG. 6 represents an example of structure wherein a substantially large diameter weighted mass or slug 16 is disposed within the bore 18 of the tubular member 12 having integral end walls 14 each swaged or otherwise formed radially inwardly such as to leave an aperture 20 of relatively large diameter. The relatively large aperture 20 permits air to escape from the bore 18 in the tubular member 12 when the relatively large diameter weighted mass or slug 16 is displaced from one end of the bore to the other. The same result of preventing compressing air between the closure walls and the faces of the weighted mass or slug 16 during displacement of the weighted mass or slug is accomplished in the structure of FIGS. 7–7(*a*), consisting of a tubular member 12 provided at each end with a closure cap 28, by a plurality of apertures 30 disposed through the closure cap. The apertures 30 place the internal bore 18 of the tubular member 12 in communication with the ambient, such as to permit air to be expelled from the bore 18 and to be introduced into the bore during displacement of the relatively large diameter weighted mass or slug 16. The same results are also achieved, without placing the internal bore 18 of the tubular member 12 in direct communication with the ambient, by disposing in the bore 18 of the tubular member 12 a tubular slug 32, FIG. 8, having a relatively large diameter bore 34 enabling the air contained within the bore 18 of the tubular member 12 to freely pass from one side of the tubular slug 32 to the other during displacement of the slug for impacting against one or the other of the closure caps 28.

Figure 9:
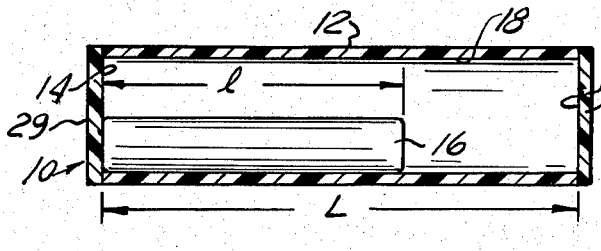

The weighted mass or slug 16 may have any appropriate length as long as it is shorter than the overall length of the internal bore 18 of the tubular member 12 between the end walls 14 so as to cause an impact sound to be heard by the user when the weighted mass or slug 16 is forcibly projected such as to impact against an end wall. It has been discovered that, in order for the impact noise to be heard distinctly, the ratio of the overall length l, FIG. 9, of the weighted mass or slug 16 to the total length L of the internal bore 18 of the tubular member 12 between the end walls 14 should preferably be at most 4 to 7. For example, if the total length L of the bore 18 of the tubular member 12 between the end walls 14 is 90 mm. (about 3.5 inches), the overall length l of the weighted mass or slug 16 is preferably not more than 50 mm. (about 2 inches). In the structure of FIG. 9, the rhythm indicator and exercising device 10 is made simply of a tubular member 12, metallic or made of plastic provided with metallic or plastic end walls 14, each made of a disk fastened at an end of the tubular member 12.

It will be appreciated that the tubular member 12, whether made of plastic material or of metal, can be used as such or, preferably, it can be used disposed in a protective and decorative exterior sleeve, whether or not the sleeve is provided with a grip-like superficial contour. It will also be appreciated that placing the tubular member in a sleeve, closed at both ends, may somewhat tend to deaden the impact noise of the weighted mass or slug when hitting the end walls and that, in structures where it is desired to further deaden the impact noise, the end walls, especially when made in the form of closure caps, may be made of substantially elastomeric material.

Having thus described the present invention by way of typical examples of structure thereof, modifications whereof will be apparent to those skilled in the art, what is claimed as novel is as follows:

1. An exercising device comprising an elongated circularly cylindrical member of a convenient diameter to be gripped by a hand, a longitudinal bore of substantially constant diameter extending from end to end within said elongated member, a freely movable single-piece weighted mass within said bore adapted to be displaceable from end to end therein, and a pair of substantially rigid end walls, each of said end walls being disposed at an end of said bore for impacting by said weighted mass and for emitting an audible sound upon impact shock with said weighted mass, wherein the ratio of the length of said weighted mass to the length of the bore in said elongated member between said end walls is at most 4 to 7 and wherein one of said end walls is formed integral with said elongated member at an end of said elongated member.

2. The device of claim 1 wherein the other of said end walls is formed integral with said elongated member at the other end of said elongated member.

3. The device of claim 1 wherein each of said end walls is provided with at least one aperture for providing communication between said bore and the ambient.

4. The device of claim 1 wherein said end walls are imperforate and said weighted mass has a through bore placing each end of said weighted mass in communication with the other.

5. An exercising device comprising an elongated circularly cylindrical member of a convenient diameter to be gripped by a hand, a longitudinal bore of substantially constant diameter extending from end to end within said elongated member, a freely movable single-piece weighted mass within said bore adapted to be displaceable from end to end therein, and a pair of substantially rigid end walls, each of said end walls being disposed at an end of said bore for impacting by said weighted mass and for emitting an audible sound upon impact shock with said weighted mass, wherein the ratio of the length of said weighted mass to the length of the bore in said elongated member between said end walls is at most 4 to 7 and wherein said elongated member is disposed in a grip-like sleeve.

6. The device of claim 5 wherein at least one of said end walls is formed integral with said elongated member at an end of said elongated member.

7. The device of claim 5 wherein at least one of said end walls is a closure cap fastened at said end of said bore.

8. The device of claim 5 wherein each of said end walls is provided with at least one aperture for providing communication between said bore and the ambient.

9. The device of claim 5 wherein said end walls are imperforate and said weighted mass has a through bore placing each end of said weighted mass in communication with the other.

10. An exercising device comprising an elongated circularly cylindrical member of a convenient diameter to be gripped by a hand, a longitudinal bore of substantially constant diameter extending from end to end within said elongated member, a freely movable single-piece weighted mass within said bore adapted to be displaceable from end to end therein, and a pair of substantially rigid end walls, each of said end walls being disposed at an end of said bore for impacting by said weighted mass and for emitting an audible sound upon impact shock with said weighted mass, wherein the ratio of the length of said weighted mass to the length of the bore in said elongated member between said end walls is at most 4 to 7 and wherein said end wall is integrally formed by swaging the end of said elongated member for reducing the end of said bore to a diameter less than the diameter of said weighted mass.

11. The device of claim 10 wherein the other of said end walls is a closure cap fastened at said end of said bore.

12. The device of claim 10 wherein each of said end walls is provided with at least one aperture for providing communication between said bore and the ambient.

13. The device of claim 10 wherein said end walls are imperforate and said weighted mass has a through bore placing each end of said weighted mass in communication with the other.

14. The device of claim 10 wherein said elongated member is disposed in a grip-like sleeve.

15. An exercising device comprising an elongated circularly cylindrical member of a convenient diameter to be gripped by a hand, a longitudinal bore of substantially constant diameter extending from end to end within said elongated member, a freely movable single-piece weighted mass within said bore adapted to be displaceable from end to end therein, and a pair of substantially rigid end walls, each of said end walls being disposed at an end of said bore for impacting by said weighted mass and for emitting an audible sound upon impact shock with said weighted mass, wherein the ratio of the length of said weighted mass to the length of the bore in said elongated member between said end walls is at most 4 to 7 and wherein said elongated member is in the form of a grip-like sleeve.

16. The device of claim 15 wherein at least one of said end walls is formed integral with said elongated member at an end of said elongated member.

17. The device of claim 15 wherein at least one of said end walls is a closure cap fastened at said end of said bore.

18. The device of claim 15 wherein each of said end walls is provided with at least one aperture for providing communication between said bore and the ambient.

19. The device of claim 15 wherein said end walls are imperforate and said weighted mass has a through bore placing each end of said weighted mass in communication with the other.

* * * * *